United States Patent [19]

Rigo et al.

[11] Patent Number: 4,470,756

[45] Date of Patent: Sep. 11, 1984

[54] DEVICE FOR AXIAL SECURING OF BLADE FEET OF A GAS TURBINE DISK

[75] Inventors: Marcel L. A. Rigo, Paray Vieille Poste; Gilbert Sourdeval, Vert Saint Denis, both of France

[73] Assignee: S.N.E.C.M.A., Paris, France

[21] Appl. No.: 482,871

[22] Filed: Apr. 7, 1983

[30] Foreign Application Priority Data

Apr. 8, 1982 [FR] France ..... 82 06118

[51] Int. Cl.[3] ..... F01D 5/32

[52] U.S. Cl. ..... 416/220 R; 416/219 R

[58] Field of Search ..... 416/220 R, 219 R, 193 A, 416/219 A, 212 R, 220 A, 215, 218 R, 218 A, 221

[56] References Cited

U.S. PATENT DOCUMENTS

| | | | |
|---|---|---|---|
| 3,023,998 | 3/1962 | Sanderson | 416/220 |
| 3,096,074 | 7/1963 | Pratt | 416/221 |
| 3,397,865 | 8/1968 | Catlow | 416/221 |
| 3,936,234 | 2/1976 | Tucker et al. | 416/220 R |
| 4,349,318 | 9/1982 | Libertini et al. | 416/221 |
| 4,405,285 | 9/1983 | Surdi | 416/220 R |

FOREIGN PATENT DOCUMENTS

| | | | |
|---|---|---|---|
| 1158880 | 6/1958 | France | 416/220 |
| 2358545 | 2/1978 | France | 416/221 |
| 1259750 | 1/1972 | United Kingdom | 416/193 A |
| 2038959 | 7/1980 | United Kingdom | 416/220 |
| 2058945 | 4/1981 | United Kingdom | 416/220 |

*Primary Examiner*—Stephen Marcus
*Assistant Examiner*—John Kwon
*Attorney, Agent, or Firm*—Oblon, Fisher, Spivak, McClelland & Maier

[57] ABSTRACT

The device has two ring segments (13) held in a circumferential score (11) provided in one edge of the upper surface (8) of the rotor disk. These ring segments consist of a portion of a cylindrical band (17) on whose edges are provided two collars (18, 19) of unequal thickness. The thicker collar (18) is placed between the upper wall of the transverse score (7) made in the projection (6) and the upper wall (8) of the rotor (1). The cylindrical band (17) works in conjunction with the bottom of the circumferential score (11). The thinnest collar (19) leans against the upper wall of the groove. The two segments placed end to end leave between them a space corresponding to the width of one axial notch. By displacing the ring segments in the score, the space is brought opposite the blade to be changed. The locking ring has two pins (21) which engage between the ends of the ring segments and block them in position. Other types of applications are described.

12 Claims, 9 Drawing Figures

DEVICE FOR AXIAL SECURING OF BLADE FEET OF A GAS TURBINE DISK

The invention concerns a device for axial securing of blade root of a rotor disk of a gas turbine, for example a compressor disk on which a front cowl can be attached, the roots of the blades being secured radially in axial notches provided in the rim of the disk, the feet having a part projecting out with reference to the upstream front face of the disk disposed radially towards the center of the disk, the disk having on its upstream front face an edge with a score about the circumference, open radially towards the outside and receiving at least part of the axial locking components of the blade roots.

Numerous solutions have been proposed for axial securing of rotor blades and for providing unit disassembly and reassembly of damaged blades without the need for long and complicated dismounting of the entire rotor.

French Pat. No. 2.028.539 describes a system for securing the blades and attaching a liquid-tight jacket for cooling the blade roots. The outside disk of the rotor has axial notch in which the feet of the blades are held. A rim of diameter smaller than that described by the slot bottoms is provided on the upper surface of the disk and has a score about the circumference disposed radially towards the outside. The upper part of the roots of the blades are equipped with a projection in which a transverse notch is made, whose opening faces the center of the disk. Plates are engaged radially in the score at the circumference of the disk and in the score on the blade feet, and are maintained temporarily with pliers. When all the plates are laid on, they are positioned by turning them in a circle in front of the threaded holes made in the rim of the score which receive the bolts intended for securing the plates. Each plate holds several blade roots, and forms with them a ring channel in which cooling fluid flows. To disassemble a blade one removes the holding bolt of the corresponding plate, tipping it forward to extract the ringed score; the blade can then slide axially upward in its notch, become free and allow the extraction of the blade.

French Pat. No. 2.090.105 describes a system with similar functions. The rotor disk has on its lower face a rim whose circular score opens radially to the outside. The blade roots have toward the bottom a shoulder which comes against branchings of the L-shaped liquid sealing segments in the ring. Blocking segments are placed inside the L-shaped segments. A blocking screw is fixed in the rim of the ring and maintains the positions of the L-shaped segments and the blocking segments. Tightening screws, working in conjunction with threads provided in the blocking segments, allow action on the liquid-sealing segments. The edge of the ring is crenelated to allow access to the tightening screws. Disassembly of a given blade is possible only after extraction of the corresponding blocking and liquid-sealing segments. The chief objective of this device is not to simplify the procedure for changing blades, but rather to ensure the sealing properties of the cooling circuit.

The device according to the invention seeks to supply a device for axial securing of blade feet having a small number of components held by elements at least some of which are contained in the front cowl.

The explanations and figures supplied as examples will give a better idea of possible applications of the invention.

FIG. 1 shows an axial section of a part of a rotor. The rim of the rotor disk (1) has axial notches in which the roots (2) of the blades (3) are secured radially.

Figure 1:
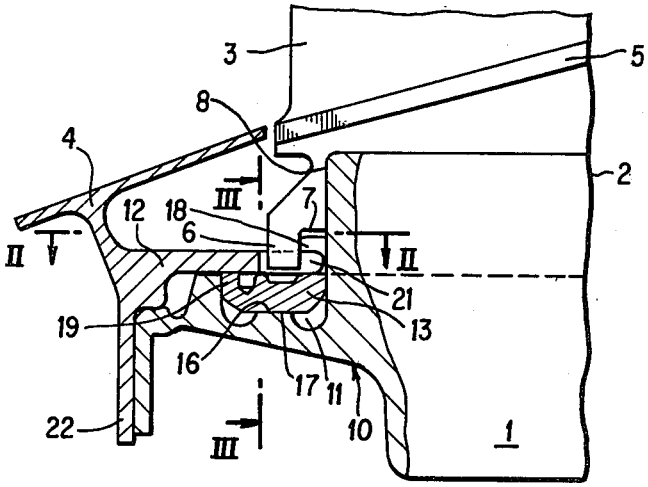
FIG. 1 is a view in axial section of part of a rotor fitted with a first type of application of the securing device according to the invention.

A front cowl (4) is fitted on the upstream front face of the disk in a piece prolonging the blade platforms (5).

The blade roots have a projection (6) jutting out with reference to the face of the disk and pointed radially towards its center. The function of this projection is to directly or indirectly prevent axial movement of the blade.

In the example shown (FIGS. 1 and 5), the projection (6) extends across the top of the root and its lower extremity has the same radius as the lower part of the blade root, or slightly larger. This projection has in radial plane a transverse score (7) whose lower edge is in the plane of the disk face (8) when the blade is in place. This form of projection allows insertion of the blade from the upstream or downstream face of the disk.

Figure 7:
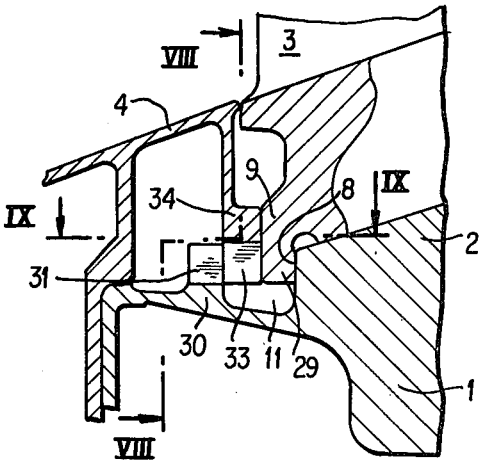
FIG. 7 is a view in axial section of a part of a rotor fitted with a third type of application of the securing device.

In the example shown in FIG. 7, the projection (9) extends beneath the plane of the lower part of the root and engages the upper surface (8) of the disk, impeding axial displacement of the blade from top to bottom.

The upstream front face of the disk (8) in FIG. 1 shows a flange (10) in which a circular score (11) is provided, opened radially towards the outside to receive at least part of the axial locking components of the blade roots.

The front locking ring (4) has an internal locking element in the form of a cylindrical ferrule (12), at whose free end is provided at least another part of the locking components working directly or indirectly in conjunction with the projection (6) of the blade roots.

The part of the locking components working in conjunction with the score (11) is composed of at least two ring segments (13, 14). The length of the ring segment formed by the ring segments set end to end is less by at least the breadth of one axial notch with reference to the circumference of one complete ring.

The opening thus obtained between the ends of ring segments (13, 14) when the other ends or extremities of intermediary segments are in contact, can, by circular sliding of the whole unit, be brought in front of any axial groove whose blade is to be changed.

Figure 2:
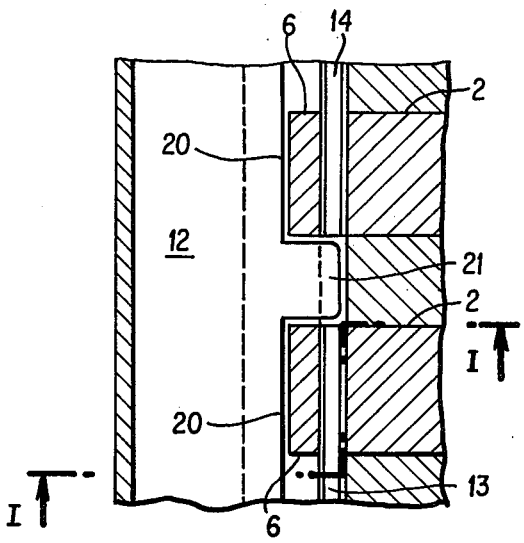
FIG. 2 is a view on line II—II of FIG. 1.
Figure 3:
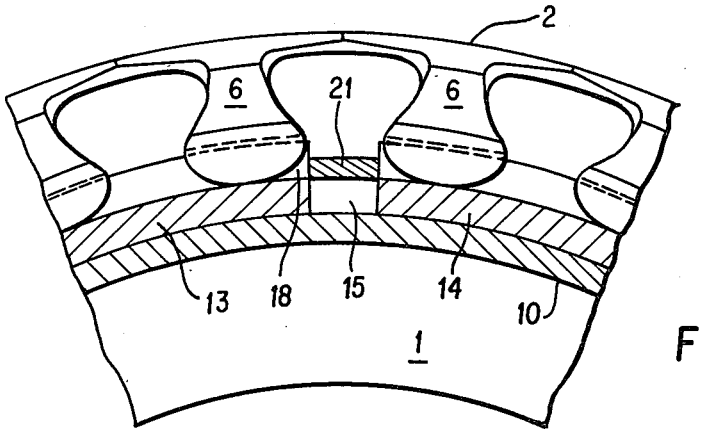
FIG. 3 is a view on line III—III of FIG. 1.

FIGS. 1 to 3 show a particular management of ring segments (13, 14) in the form of portions of cylindrical bands checked by two radial collars. The section view is roughly that of a U with unequal stems whose thickness corresponds to that of the circular score (11). To facilitate sliding, the base of the score has a circular ridge (16) on which the cylindrical interior wall (17) of the band segments rests. The longer stem of the U-section corresponds to the largest collar (18). Its dimensions are approximately equal to the depth and width of notch (7) formed in the projection (6). The shorter stem corresponds to the smaller collar (19) and its height is at most equal to the depth of the circular score (11) checked at the surface of the ridge (16).

The locking elements lodged in the front cowl (4) consist of a cylindrical ferrule (12), coaxial to the rotor disk, whose free edge (20) has two pins (21) diametrically opposed. Preferably, these pins are of equal thickness, approximately equal to one half-width of an axial groove. When the radial fixing web (22) of the front cowl is affixed to the rotor disk, the height of the pins (21) is such that each engages between the edges of segments (13, 14), and more precisely, between the edges of the collars (18) of the two adjacent segments. In that position, segments (13) and (14) leave play (15) at each end (see FIG. 3), equal to or slightly greater than half the peripheral length of the blade root. FIG. 3 shows in section on line III—III of FIG. 1 a pin (21) in place between segments (13 and 14) which block them circumferentially.

Figure 5:
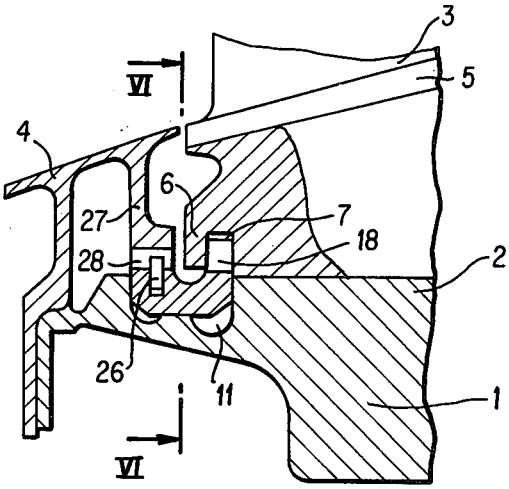
FIG. 5 is a view in axial section of a part of a rotor fitted with a second type of application of the securing device.

The coaxial sleeve can be replaced by an internal radial flange, as indicated for example as (27) and (34) of FIGS. 5 and 7.

Figure 4:
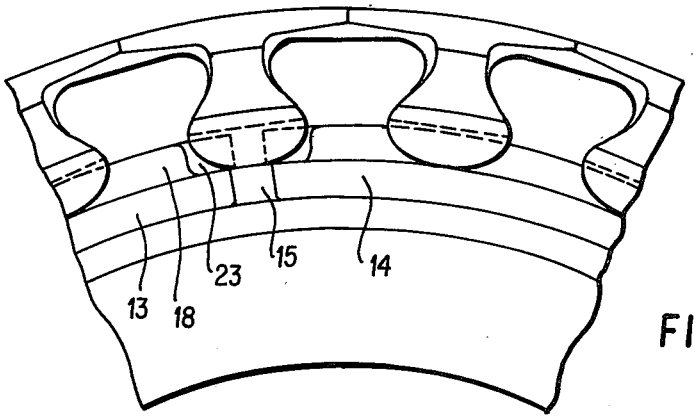
FIG. 4 is a view similar to that of FIG. 3 of another way of applying the half-rings.

FIG. 4 shows another way of configuring the ends of segments (13, 14), having in their upper edge a rectangular notch (23). The dimensions of that notch are such that, when the two segments (13, 14) are brought end to end in the circular score (11), the notches of the two non-adjacent extremities completely free up the lower part of the axial score of the radial blade holder, or at least allow passage of the projection (6). This configuration calls for an opening (15) between the ends of the lower edge of segments (13) and (14) of half a thickness with respect to the straight edges, with resulting superior securing of the segments in the score.

Figure 6:
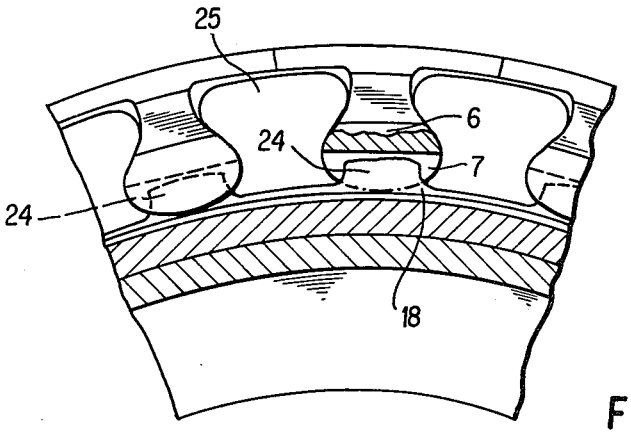
FIG. 6 is a view on line VI—VI of FIG. 5.

Another configuration of segments (13) and (14) is represented in FIGS. 5 and 6. The segments form an almost closed circle. The largest collar (18) is cut in such a way as to present teeth (24) on its outer edge. The distance between two adjacent teeth corresponds to the distance between two axial notches. By sliding the segments in the circular score (11), the teeth (24) are engaged in the notch (7) of the projection (6), or alternatively, in the teeth (25) of the rim of the rotor. These positions allow either locking or unlocking of all the blades. For the purpose of maintaining the segments in locking position for the blades, they are fitted with positioning devices consisting of bosses or pins (26) which work in conjunction with one part of the locking components located in the front cowl (4) and, specifically, with a coaxial sleeve or radial clamp (27) provided in the locking ring and whose free edge has seats or notches (28) in which the bosses or pins become lodged. Placing the front cowl on the rotor disk has the effect of locking the segments about the circumference.

The locking of the segments can also be accomplished as in FIG. 1 by means of pins located in the front cowl, seating themselves between the two or several teeth of the segments or in the lodgments provided in the smallest collar (19).

Figure 8:
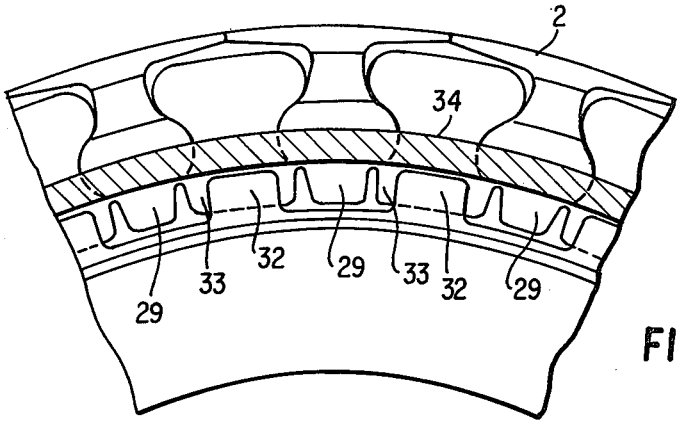
FIG. 8 is a view on line VIII—VIII of FIG. 7.
Figure 9:
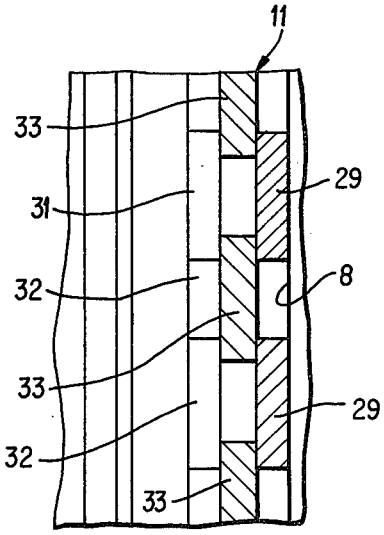
FIG. 9 is a view on line IX—IX of FIG. 7.

A third application, shown in FIGS. 7 to 9, is more specifically adapted to blades in which the part jutting out of the root or projection (29) is prolonged radially towards the center below the plane of the lower part of the root.

This disposition stops axial displacement of the blade from upstream to downstream in the notch, since the upper surface of the projection leans against the upper surface (8) of the rotor disk, permitting disassembly of the blade only in an upstream direction.

For disassembly of the blade, there are provided indentations (31) in the upper edge (30) of the circumferential score (11), opposite the axial notches, which indentations form teeth (32) that constitute part of the locking components. The other part of the bolting components located in the front cowl are also made up of teeth (33) of such size and shape that they engage in the indentations (31) of the edge of the score (11) and between the teeth (32) of that edge and the upper surface of the blade projection (29). The teeth (33) are formed in the free edge of a cylindrical ferrule or of a radial flange (34) provided in the front cowl. The locking or unlocking of the blades is accomplished when the front cowl is put in place, by rotating it one half thread corresponding to the distance between one axial notch and the adjacent tooth of the rotor disk. It can be seen that the teeth (32) constitute intermediary binding elements which bear stresses without being so thick as to constitute an excessive mass.

The different types of application described can be used in the case of blades whose roots are maintained in axial notches inclined from above to below on the axis, as shown in FIG. 7. This inclined fixation provides lightened stresses in an upward direction and allows a lighter construction of the front cowl.

We claim:

1. A gas turbine having an axial securing device for the roots of the blades of the rotor disc of the gas turbine which permits the blades to be readily disengaged from the rotor disc, said gas turbine comprising:

(a) a rotor disc having an upstream front face, a downstream rear face, a radially outer rim, a plurality of axial notches in the radially outer rim, an axially projecting flange on the upstream front face, and a circumferential, radially outwardly open score on the radially outward surface of said axially projecting flange;

(b) a front cowl removably fitted on the upstream front face of said rotor disc;

(c) a plurality of rotor blades, each of said plurality of rotor blades having a blade root which is axially slidably disposed in a corresponding one of said plurality of axial notches and a project which extends axially forwardly and radially inwardly from the upsteam front face of the associated one of said plurality of rotor blades;

(d) at least two ring segments slidably disposed in said circumferential score and circumferentially movable therein, said ring segments having a radially outwardly projecting collar which extends radially outwardly farther than said plurality of projections extend radially inwardly, said ring segments and said circumferential score being positioned such that the front surface of said radially outwardly projecting collars abut against the rear surfaces of said plurality of projections, thereby preventing rearward axial movement of said rotor blades, when said ring segments and said projections are circumferentially aligned, the sum of the lengths of said ring segments being less by at least the circumferential width of one of said axial notches than the circumference of said circumferential score, whereby said ring segments can be slid into a position in said circumferential score permitting at least one of said rotor blades to be disengaged from said rotor disc; and (e) a locking element carried by the downstream rear face of said front cowl, said locking element selectively engaging said ring semgents to prevent circumferential movement thereof and to circumferentially fix said ring segments in position to engage said plurality of projections, thereby preventing rearward axial movement of said rotor blades.

2. A gas turbine as recited in claim 1 wherein said axial notches and said blade roots are sized and shaped to prevent radial displacement of said rotor blades when said rotor blades are disposed in said axial notches.

3. A gas turbine as recited in claim 1 wherein the radially inward extremities of said projections are at or radially outward of the radially inward surfaces of said blade roots.

4. A gas turbine as recited in claim 1 wherein the radially inward extremities of said projections are radially inward of the radial inward surfaces of said blade roots and engage the upstream surface of said rotor disc, thereby permitting disassembly of said rotor blades only in the upstream direction.

5. A gas turbine as recited in claim 4 wherein indentations are provided in the radially outward, axially upstream edge of said circumferential score circumferentially aligned with said axial notches, the portion of said axially projecting flange between said indentations forming teeth which engage corresponding teeth carried by said front cowl to prevent axial movement of said rotor blades when said teeth on said axially projecting flange and said teeth on said front cowl are aligned.

6. A gas turbine as recited in claim 1 and further comprising a cylindrical ferrule carried by said front cowl, the radially inner surface of the axially rearward portion of said cylindrical ferrule engaging the radially outer surface of the axially foward portions of said ring segments, thereby confining said ring segments in said circumferential score.

7. A gas turbine as recited in claim 1 wherein said locking element comprises a cylindrical ferrule carried by said front cowl, said cylindrical ferrule having two axially rearwardly extending pins diametrically oppositely located thereupon, said axially extending pins extending between said ring segments to prevent circumferential motion thereof when said front cowl is fitted on the upstream front face of said rotor disc.

8. A gas turbine as recited in claim 1 and further comprising a radial flange carried by said front cowl, the radially inner surface of said radial flange engaging the radially outer surface of the axially forward portions of said ring segments, thereby confining said ring segments in said circumferential score.

9. A gas turbine as recited in claim 1 wherein said locking element comprises a radial flange carried by said front cowl and at least one boss or pin selectively connecting said ring segments to said front cowl so as to prevent circumferential motion of said ring segments in said circumferential score.

10. A gas turbine as recited in claim 1 wherein said root segments have notches in the radially outer surfaces of said collars, said notches opening circumferentially at the adjacent ends of adjoining ring segments, said notches being sized to permit axial movement of one of said rotor blades when said notches are circumferentially aligned with said one of said rotor blades.

11. A gas turbine as recited in claim 1 wherein said collars have outwardly projecting teeth on the radially outward edges, the distance between two adjacent teeth corresponding to the distance between adjacent ones of said axial notches, and said rotor blades have corresponding inwardly projecting teeth, whereby circumferential movement of said ring segments permits simultaneous locking and unlocking of all of said rotor blades.

12. A gas turbine as recited in claim 11 wherein said locking element comprises at least one boss or pin selectively connecting said ring elements to said front cowls so as to prevent circumferential motion of said ring segments in said circumferential score.

* * * * *

UNITED STATES PATENT AND TRADEMARK OFFICE

CERTIFICATE OF CORRECTION

PATENT NO. : 4,470,756

DATED : September 11, 1984

INVENTOR(S) : Marcel L. A. Rigo, Gilbert Sourdeval

It is certified that error appears in the above-identified patent and that said Letters Patent is hereby corrected as shown below:

Abstract, line 11, change "groove" to -- score --;

Abstract, line 15, change "locking ring" to -- front cowl --;

Column 1, heading, change "BLADE" to -- ROOTS --;

Column 1, line 6, change "blade root" to -- the blade roots --;

Column 1, line 21, change "2.028.539" to -- 2,028,539 --;

Column 1, line 24, change "notch" to -- notches --;

Column 1, line 44, change "2.090.105" to -- 2,090,105 --.

Column 2, line 45, change "locking ring" to -- front cowl --;

Column 2, line 60, change "groove" to -- notch --;

Column 3, line 44, change "notches." to -- scores. --;

Column 4, line 10, change "bolting" to -- locking --;

UNITED STATES PATENT AND TRADEMARK OFFICE

CERTIFICATE OF CORRECTION

PATENT NO. : 4,470,756

DATED : September 11, 1984

INVENTOR(S) : Marcel L. A. Rigo, Gilbert Sourdeval

It is certified that error appears in the above-identified patent and that said Letters Patent is hereby corrected as shown below:

In Column 4, line 30, change "construction" to -- structure --;

In Column 5, line 6, change "semgents" to -- segments --;

In Column 5, line 40, change "foward" to -- forward --;

Signed and Sealed this

*Twenty-fourth* Day of *June 1986*

[SEAL]

*Attest:*

DONALD J. QUIGG

*Attesting Officer*

*Commissioner of Patents and Trademarks*